US009091502B1

(12) United States Patent
Morrison

(10) Patent No.: US 9,091,502 B1
(45) Date of Patent: Jul. 28, 2015

(54) LIGHT-ENHANCED FIREARM SUPPRESSOR

(71) Applicant: Robert Scott Morrison, Hoschton, GA (US)

(72) Inventor: Robert Scott Morrison, Hoschton, GA (US)

( * ) Notice: Subject to any disclaimer, the term of this patent is extended or adjusted under 35 U.S.C. 154(b) by 0 days.

(21) Appl. No.: 14/134,044

(22) Filed: Dec. 19, 2013

Related U.S. Application Data

(60) Provisional application No. 61/836,508, filed on Jun. 18, 2013, provisional application No. 61/872,012, filed on Aug. 30, 2013, provisional application No. 61/892,070, filed on Oct. 17, 2013, provisional application No. 61/892,087, filed on Oct. 17, 2013.

(51) Int. Cl.
*F41A 21/30* (2006.01)
*F41G 11/00* (2006.01)
*F41G 3/14* (2006.01)

(52) U.S. Cl.
CPC ..... *F41A 21/30* (2013.01); *F41G 3/145* (2013.01); *F41G 11/001* (2013.01)

(58) Field of Classification Search
USPC ..... 181/223; 89/14.2; 42/114, 131, 132, 42/146
See application file for complete search history.

(56) References Cited

U.S. PATENT DOCUMENTS

| | | | | |
|---|---|---|---|---|
| 1,017,003 | A | 2/1912 | Kenney | |
| 1,482,805 | A | 2/1924 | Maxim | |
| 2,792,760 | A | 5/1957 | Hammer | |
| 3,385,164 | A | 5/1968 | Walther et al. | |
| 4,291,610 | A | 9/1981 | Waiser | |
| 4,530,417 | A | 7/1985 | Daniel | |
| 4,576,083 | A | 3/1986 | Seberger | |
| 4,584,924 | A | 4/1986 | Taguchi | |
| 4,588,043 | A | 5/1986 | Finn | |
| 4,869,151 | A | 9/1989 | Chahin | |
| 4,907,488 | A | 3/1990 | Seberger, Jr. | |
| 4,974,489 | A | 12/1990 | Fishbaugh | |
| 5,029,512 | A | 7/1991 | Latka | |
| 5,092,223 | A | 3/1992 | Hudson | |
| 5,136,923 | A * | 8/1992 | Walsh, Jr. | 89/14.2 |
| 5,164,535 | A | 11/1992 | Leasure | |
| 5,425,299 | A * | 6/1995 | Teetzel | 89/14.4 |
| 5,476,028 | A | 12/1995 | Seberger, Jr. | |
| 5,610,360 | A | 3/1997 | Kazyaka et al. | |
| 5,773,746 | A | 6/1998 | Vaden | |
| D415,812 | S | 10/1999 | Andrews, Jr. et al. | |
| D415,813 | S | 10/1999 | O'Quinn et al. | |
| D435,623 | S | 12/2000 | Andrews, Jr. et al. | |
| 6,302,009 | B1 | 10/2001 | O'Quinn et al. | |
| 6,308,609 | B1 | 10/2001 | Davies | |
| 6,374,718 | B1 | 4/2002 | Rescigno et al. | |
| 6,575,074 | B1 | 6/2003 | Gaddini | |
| 7,073,426 | B1 | 7/2006 | White | |
| 7,194,836 | B1 * | 3/2007 | Urban | 42/60 |

(Continued)

OTHER PUBLICATIONS

U.S. Office Action mailed on Sep. 4, 2014 in U.S. Appl. No. 14/134,023.

*Primary Examiner* — Jeremy Luks
(74) *Attorney, Agent, or Firm* — Hartman & Citrin LLC

(57) ABSTRACT

Embodiments of a light-enhanced firearm suppressor are disclosed herein. According to various embodiments, the light-enhanced firearm suppressor can include a housing. The housing can include an outer surface, an inner cavity, and an attachment mechanism that attaches the housing to a barrel of a firearm. The inner cavity can accommodate a baffle. The light-enhanced firearm suppressor also can include a lighting attachment. The lighting attachment can include a power source and a lighting mechanism.

20 Claims, 8 Drawing Sheets

(56) References Cited

U.S. PATENT DOCUMENTS

| | | | | |
|---|---|---|---|---|
| 7,325,474 | B2 | 2/2008 | Yoshimura et al. | |
| D594,082 | S | 6/2009 | O'Quinn | |
| 7,854,085 | B1 * | 12/2010 | Hodgkins et al. | 42/85 |
| 7,905,171 | B1 | 3/2011 | Brittingham | |
| 8,096,222 | B2 | 1/2012 | Silvers | |
| 8,162,100 | B2 | 4/2012 | Shults et al. | |
| 8,167,084 | B1 | 5/2012 | Moore | |
| 8,439,155 | B2 | 5/2013 | Shults et al. | |
| 8,479,632 | B2 | 7/2013 | Kline et al. | |
| 8,479,878 | B2 | 7/2013 | Schlosser | |
| 2007/0107590 | A1 | 5/2007 | Silvers | |
| 2010/0126334 | A1 | 5/2010 | Shults et al. | |
| 2011/0067950 | A1 | 3/2011 | Shults et al. | |

* cited by examiner

LIGHT-ENHANCED FIREARM SUPPRESSOR

CROSS-REFERENCE TO RELATED APPLICATIONS

This application claims priority to U.S. Provisional Patent Application No. 61/836,508, filed Jun. 18, 2013, entitled "Improved Suppressor," which is incorporated herein by reference in its entirety. This application also claims priority to U.S. Provisional Patent Application No. 61/872,012, filed Aug. 30, 2013, entitled "Light Enhanced Firearm Suppressor," which is incorporated herein by reference in its entirety. This application also claims priority to U.S. Provisional Patent Application No. 61/892,070, filed Oct. 17, 2013, entitled "Superior Signature Suppressor," which is incorporated herein by reference in its entirety. This application also claims priority to U.S. Provisional Patent Application No. 61/892,087, filed Oct. 17, 2013, entitled "Improved Surface Treatment Suppressor," which is incorporated herein by reference in its entirety. This application also is related to U.S. patent application Ser. No. 14/134,023, filed Dec. 19, 2013, entitled "Firearm Suppressor," now U.S. Pat. No. 9,038,770, which is incorporated herein by reference in its entirety.

TECHNICAL FIELD

This disclosure relates generally to firearm technologies. More particularly, the disclosure made herein relates to light-enhanced firearm suppressors that function as firearm suppressors and as firearm accessories such as lighting devices, sighting devices, and other accessories.

BACKGROUND

Unless otherwise indicated herein, the materials described in this section are not prior art to the claims in this application and are not admitted to be prior art by inclusion in this section.

Firearm suppressors are sometimes referred to as "silencers." The term "silencer," however, while being partially accurate, does not explain or identify the various functions of a well-manufactured and well-used suppressor. In particular, a suppressor functions to not only suppress an audible signature of a firearm, but also to suppress the muzzle flash and other visible signatures of firearms. As such, suppressors can be used to allow firearm use without personal hearing protection. In military applications, suppressors can reduce detectability, as well as allowing soldiers or other entities to discharge firearms without compromising their ability to hear other sounds in their environment.

Because suppressors can allow shooters to discharge firearms without personal hearing protection, and to reduce the muzzle flash and other visible effects of firearm discharge, suppressors have become popular accessories with shooters. In fact, some shooters wish to acquire a suppressor for each owned firearm after firing a suppressed firearm due to the reduced sound and flash of a firearm discharge. In general, suppressors can make shooting more enjoyable.

The benefits of suppressors, however, are not limited to comfort and enjoyment. Suppressors also can be used for personal defense, military applications, hunting, and the like. In particular, because adrenaline-inducing events can result in visual distortion such as tunnel vision, depth perception issues, and the like, some firearm owners equip personal defense firearms with suppressors to reduce the likelihood of such issues in a violent encounter. For military applications, suppressors can aid soldiers in stealthily attacking targets with firearms by reducing the detectability of the firearms visually and audibly.

For these and other reasons, suppressors have become popular accessories for firearm owners and users. Suppressors, however, are expensive to make and therefore are expensive to own. Additionally, the regulatory framework around suppressor manufacturing and ownership combine with the high cost of manufacturing to result in limited suppressor ownership and availability.

SUMMARY

Concepts and technologies are disclosed herein for a light-enhanced firearm suppressor. In some embodiments, a light-enhanced firearm suppressor can include a housing and a connection mechanism configured to engage a lighting attachment. The lighting attachment can be connected to the housing using the connection mechanism to form a light-enhanced firearm suppressor. According to various embodiments, the connection mechanism can include threads, clips, snaps, pressure fits, magnetic attachment mechanisms, mechanical engagement mechanisms such as hooks, latches, or the like, rivets, welds, adhesives, pins, bolts, screws, combinations thereof, or the like.

The lighting attachment can include one or more lighting mechanisms and a power source for powering the lighting mechanisms. The power source can include a battery or a connection to an integrated or external power source such as solar panels, batteries, hardwire power sources, combinations thereof, or the like. The lighting mechanisms can include, for example, light bulbs, light emitting diodes ("LEDs"), luminescent panels, combinations thereof, or the like, configured to emit visible or invisible light. The lighting mechanisms also can include sighting systems or devices such as lasers or the like, for use in targeting. The lighting attachment can be activated via one or more switches and used to provide light, to send signals, to sight the firearm on a target, and/or for other reasons.

According to one aspect of the concepts and technologies described herein, a light-enhanced firearm suppressor is disclosed. The light-enhanced firearm suppressor can include a housing. The housing can include an outer surface, an inner cavity, and an attachment mechanism. The attachment mechanism can attach the housing to a barrel of a firearm. The inner cavity can accommodate a baffle. The light-enhanced firearm suppressor also can include a second attachment mechanism that can attach a lighting attachment to the housing. The lighting attachment can include a power source and a lighting mechanism.

In some embodiments, the housing can be formed from aluminum, the attachment mechanism can include female threads that engage male threads on the barrel, and the second attachment mechanism can include male threads that can engage female threads on the lighting attachment. In some embodiments, the housing can be formed from extruded aluminum, and the lighting attachment can include a lighting mechanism and a power source. In some embodiments, the lighting attachment can include a lighting mechanism and a power source, the lighting mechanism can include a light bulb, and the power source can include a battery. In some embodiments, the lighting attachment can include a lighting mechanism and a power source, the lighting mechanism can include a light emitting diode, and the power source can include a battery.

In some embodiments, the lighting attachment can include a lighting mechanism and a power source, the lighting mechanism can include a plurality of light emitting diodes radially arranged around a bullet aperture formed in the lighting attachment, and the power source can include at least one battery. The lighting attachment can be attached to the housing using bolts or other connection mechanisms, in some embodiments. The lighting attachment can include a laser emitting sighting system or other light emitting devices.

According to another aspect of the concepts and technologies described herein, a light-enhanced firearm suppressor is disclosed. The light-enhanced firearm suppressor can include a housing. The housing can include an outer surface, an inner cavity, and an attachment mechanism. The attachment mechanism can be used to attach the housing to a barrel of a firearm. The inner cavity can accommodate a baffle. The light-enhanced firearm suppressor also can include a lighting attachment. The lighting attachment can include a power source and a lighting mechanism.

In some embodiments, the lighting attachment can be connected to the housing using threads formed on the housing and further threads formed on the lighting attachment. The lighting attachment can include at least one lighting mechanisms, and the power source can include at least one battery. In some embodiments, the lighting mechanism can include at least one light emitting diode. The lighting attachment also can be formed as a part of the housing. The housing can be formed from aluminum, and the lighting attachment can include a lighting mechanism and a power source. The housing can be formed from titanium, and the lighting attachment can include a lighting mechanism and a power source. The housing can be formed from steel, and the lighting attachment can include a lighting mechanism and a power source.

According to yet another aspect of the concepts and technologies described herein, a light-enhanced firearm suppressor is disclosed. The light-enhanced firearm suppressor can include a housing. The housing can include an outer surface, an inner cavity, and an attachment mechanism. The attachment mechanism can attach the housing to a barrel of a firearm, and the inner cavity can accommodate a baffle. The light-enhanced firearm suppressor also can include a second attachment mechanism that can be used to attach a lighting attachment to the housing. The lighting attachment can include a power source and a lighting mechanism, and the lighting attachment can include a lighting mechanism and a power source including a battery.

In some embodiments, the lighting mechanism can emit light in a visible wavelength. In some other embodiments, the lighting mechanism can emit light in an invisible wavelength. The lighting attachment can include a lighting mechanism and a power source, the lighting mechanism can include a plurality of light emitting diodes radially arranged around a bullet aperture formed in the lighting attachment, the power source can include at least one battery, and at least one of the housing, the baffle, and the lighting attachment can be formed from heat-anodized titanium.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1A:
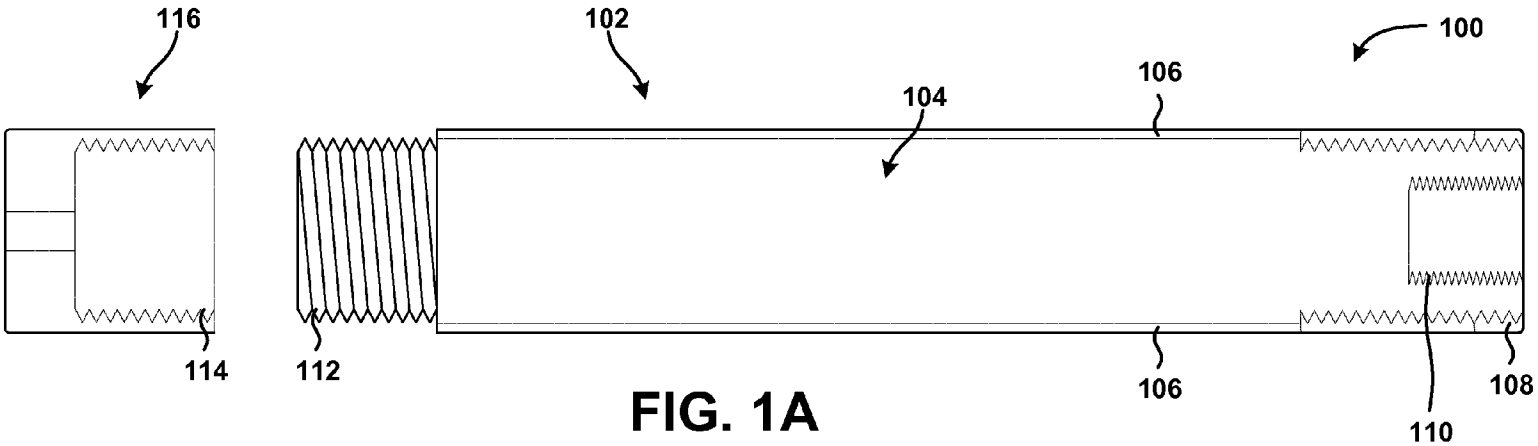
FIG. 1A is a line drawing illustrating an assembly view of a light-enhanced firearm suppressor, according to an illustrative embodiment of the concepts and technologies described herein.

The following detailed description is directed to a light-enhanced firearm suppressor. In some embodiments, a light-enhanced firearm suppressor can include a housing and a connection mechanism configured to engage a lighting attachment. The lighting attachment can be connected to the housing using the connection mechanism to form a light-enhanced firearm suppressor. The connection mechanism can include threads, clips, snaps, latches, pressure-fit connections, magnetic mechanisms, mechanical fasteners, rivets, welds, adhesives, pins, bolts, screws, combinations thereof, or the like.

The lighting attachment can include one or more lighting mechanisms and a power source for powering the lighting mechanisms. The power source can include a battery. The power source also can include one or more connections to integrated or external power sources such as, for example, batteries, alternative power sources, hardwire connections, combinations thereof, or the like. The lighting mechanisms can include, for example, light bulbs, light emitting diodes ("LEDs"), luminescent panels, lasers, combinations thereof, or the like. The lighting mechanisms can be configured to emit visible or invisible light. The lighting mechanisms also can include sighting systems or devices such as lasers or the like, for use in targeting. These and other embodiments of the concepts and technologies described herein will be illustrated and described in detail below.

In the following detailed description, references are made to the accompanying drawings that form a part hereof, and in which are shown by way of illustration specific embodiments or examples. It must be understood that the disclosed embodiments are merely illustrative of the concepts and technologies disclosed herein. The concepts and technologies disclosed herein may be embodied in various and alternative forms, and/or in various combinations of the embodiments disclosed herein. The word "illustrative," as used in the specification, is used expansively to refer to embodiments that serve as an illustration, specimen, model or pattern.

Additionally, it should be understood that the drawings are not necessarily to scale, and that some features may be exaggerated or minimized to show details of particular components. In other instances, well-known components, systems, materials or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure. Referring now to the drawings, in which like numerals represent like elements throughout the several figures, aspects of light-enhanced firearm suppressors will be presented.

Turning to FIG. 1A, an illustrative embodiment of a light-enhanced firearm suppressor 100 will be described. For purposes of illustrating and describing various embodiments of the concepts and technologies described herein, the overall and/or basic structure of the light-enhanced firearm suppressor 100 will be briefly described. While the light-enhanced firearm suppressor 100 may include various elements also included in standard suppressors, this discussion is provided herein to establish terminology used herein and therefore should not be viewed as being limiting in any way. Because the concepts and technologies described herein for providing a light-enhanced firearm suppressor 100 can be embodied in various implementations of suppressors, it should be understood that the illustrated and described illustrative embodiment is merely one example of a suitable operating environment for the concepts and technologies described herein for providing a light-enhanced firearm suppressor. As such, the illustrated and described embodiments should not be construed as being limiting in any way of the concepts and technologies described herein.

In some embodiments, as shown in FIG. 1A, the light-enhanced firearm suppressor 100 disclosed herein can include a housing 102. The housing 102 can be formed from an assembly of two or more components, in some embodiments, of the housing 102 may be formed as a substantially continuous piece of material. According to various embodiments, including the embodiment shown in FIG. 1, the housing 102 is formed as a substantially cylindrical structure that has an inner cavity 104 defined by an outer surface 106.

It can be appreciated that the housing 102 can be configured to house a baffle and/or other structures and/or elements, though this is not necessarily the case. Various embodiments of baffles and/or other structures or elements that can be located within the inner cavity 104 are illustrated and described in co-pending U.S. Provisional Patent Application No. 61/836,508, filed Jun. 18, 2013, entitled "Improved Suppressor," which is incorporated herein by reference in its entirety, and co-pending U.S. patent application Ser. No. 14/134,023, entitled "Firearm Suppressor," filed on Dec. 19, 2013, which is incorporated herein by reference in its entirety. Because other baffles and/or other structures and/or elements are possible and are contemplated, it should be understood that these examples are illustrative and therefore should not be construed as being limiting in any way.

The housing 102 also can include and/or can engage an endcap 108, which can be located at a leading edge of the light-enhanced firearm suppressor 100. The endcap 108 can include and/or can be configured to engage barrel threads 110 or other structures. According to various embodiments of the concepts and technologies described herein, the barrel threads 110 are configured to engage a barrel of a firearm (not shown in FIG. 1A). Thus, the barrel threads 110 can be used to hold the light-enhanced firearm suppressor 100 in an operating configuration, as generally is understood by one familiar with the operation of firearm suppressors. Because the endcap 108 and the barrel threads 110 are generally understood structural elements of firearm suppressors such as the light-enhanced firearm suppressor 100, these elements are not further described herein.

The housing 102 and/or the components of the housing may be formed by various processes and/or materials. According to various embodiments of the concepts and technologies described herein, the housing 102 can be formed from metals and/or alloys such as, for example, steel, aluminum, titanium, brass, copper, other metals or alloys, combinations thereof, or the like. The housing 102 also can be formed from resins such as epoxy resins, or the like, as well as various polymers such as various thermoplastics, polypropylene, polycarbonates, graphite filled NYLON, phenolics, polyimides, and/or other polymers, combinations thereof, or the like. The housing 102 can be formed using various processes such as, for example, extrusion, machining, injection molding, casting, combinations thereof, or the like.

In one contemplated embodiment, the housing 102 is formed from extruded aluminum. The housing 102 can be treated for various purposes such as, for example, to enhance strength, to add corrosion resistance, for aesthetic purposes, combinations thereof, or the like. In some embodiments, the housing 102 is anodized aluminum. In some other embodiments, the housing 102 is formed from titanium and is treated with a heat anodization process. It should be understood that these examples are illustrative and therefore should not be construed as being limiting in any way.

The housing 102 also can include lighting attachment threads 112. The lighting attachment threads 112 can be replaced and/or supplemented with other attachment mechanisms, if desired, such as rivets, bolts, compression fittings, pins, combinations thereof, or the like. In the illustrated embodiment, the lighting attachment threads 112 are configured to engage reciprocal housing attachment threads 114 of a lighting attachment 116. The lighting attachment 116 can function as a trailing edge cap at a trailing edge of the housing 102, in some embodiments. Because the lighting attachment threads 112 can be replaced and/or supplemented with additional and/or alternative attachment mechanisms, it should be understood that the housing attachment threads 114 of the lighting attachment 116 can be replaced and/or supplemented with additional and/or alternative connection mechanisms and/or reciprocal connection mechanisms. It should be understood that this example is illustrative and therefore should not be construed as being limiting in any way.

Figure 1B:
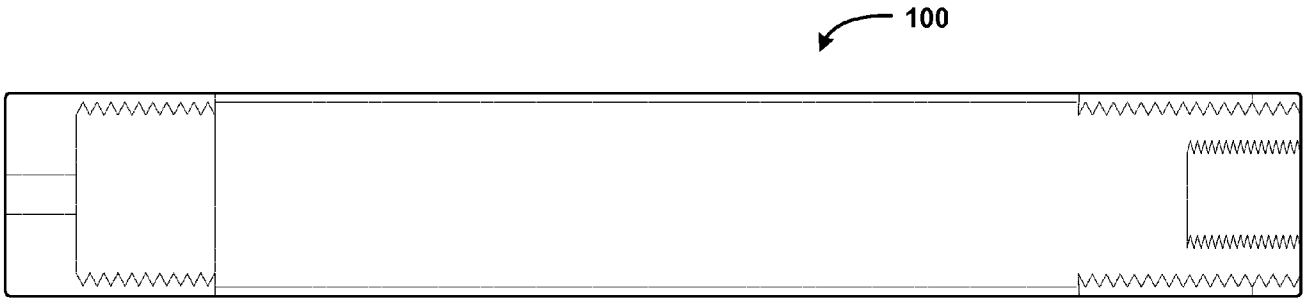
FIG. 1B is a line drawing illustrating a light-enhanced firearm suppressor, according to another illustrative embodiment of the concepts and technologies described herein.

According to various embodiments, as shown with collective reference to FIGS. 1A and 1B, the lighting attachment 116 can be connected to the housing 102 by mating connection mechanisms on the housing 102 and the lighting attachment 116, for example the lighting attachment threads 112 and the housing attachment threads 114, respectively. Although not visible in FIGS. 1A-1B, it should be understood that other structures can be located between the housing 102 and the lighting attachment 116, for example a plastic or silicone washer, padding, combinations thereof, or the like.

Although not visible in FIGS. 1A-1B, the lighting attachment 116 can be used to provide functionality associated with an accessory to users of the light-enhanced firearm suppressor 100. Various embodiments of the lighting attachment 116 and/or light-enhanced firearm suppressors 100 formed from the various embodiments of the lighting attachment 116 are illustrated and described in additional detail below with reference to FIGS. 2A-7B. Briefly, the lighting attachment 116 can be used to provide lighting functionality for the light-enhanced firearm suppressor 100. Thus, for example, a lighting device for a firearm may be omitted, replaced by, and/or supplemented with the lighting attachment 116.

According to various embodiments, for example, the light-enhanced firearm suppressor 100 can be used for personal defense applications. Thus, the lighting attachment 116 can be used to simultaneously provide a user of the firearm with suppression functionality as well as lighting functionality. As will be explained in additional detail herein, the lighting mechanisms included in the lighting attachment 116 can include lighting devices configured to emit streams of light, light pulses, and/or flashes of light; light produced in visible and/or invisible spectra (e.g., visible white light, ultra-violet light, infrared light, etc.); laser beam emitters configured to emit one or more laser beams (e.g., for sighting purposes); combinations thereof; or the like. As such, the lighting attachment 116 can be used to provide various lighting capabilities for a firearm user and/or other entity. It should be understood that these examples are illustrative and therefore should not be construed as being limiting in any way.

Thus, the lighting attachment 116 can be used to enable a user of the light-enhanced firearm suppressor 100 to identify a target and/or to sight the firearm on a desired target. The lighting attachment 116 also can be used to generate flashes or pulses of light to confuse or disorient a target, as is generally understood in the art of personal defense and/or offensive firearm use in military and/or law enforcement applications. The lighting attachment 116 also can be configured to generate messages and/or signals using light sources, if desired. In one contemplated embodiment, for example, the lighting attachment 116 can be configured to emit pulses of light in an order and/or durations that signal a particular message such as, for example, S-O-S messages, or the like. Because the lighting attachment 116 can be configured to generate light in almost any spectrum, for almost any duration and/or sequence, and/or with various types of lighting mechanisms, it should be understood that these examples are illustrative and therefore should not be construed as being limiting in any way.

Although not visible in FIGS. 1A-1B, it should be understood that the light-enhanced firearm suppressor 100 and/or the lighting attachment 116 can include activation and/or deactivation switches or devices. In one contemplated embodiment, a pressure switch can be provided for the lighting attachment 116 and/or the light-enhanced firearm suppressor 100. The pressure switch can be located in a position at which a firearm user can activate the lighting attachment 116. For example, one embodiment of the light-enhanced firearm suppressor 100 includes a pressure switch or other type of switch located at a firearm grip, trigger, or other location. The switch can be activated at the grip or other location, and a signal from the switch can be received by the light-enhanced firearm suppressor 100 and/or the lighting attachment 116 to activate or deactivate the lighting attachment 116. It should be understood that these examples are illustrative and therefore should not be construed as being limiting in any way.

According to various embodiments of the concepts and technologies described herein, the lighting attachment 116 can include lighting devices that operate using various illumination technologies. For example, the lighting devices can include laser emitters, light emitting diodes ("LEDs"), incandescent lighting technologies such as filament bulbs, halogen bulbs, krypton bulbs, or the like; chemo-luminescent materials; diodes; combinations thereof, or the like. Because the lighting attachment 116 can be configured to use almost any type of lighting technology and/or combinations thereof, it should be understood that these examples are illustrative and therefore should not be construed as being limiting in any way. Various embodiments of the lighting attachment 116 and/or the lighting devices will be illustrated and described in additional detail below, particularly with reference to FIGS. 2A-7B.

Figure 2A:
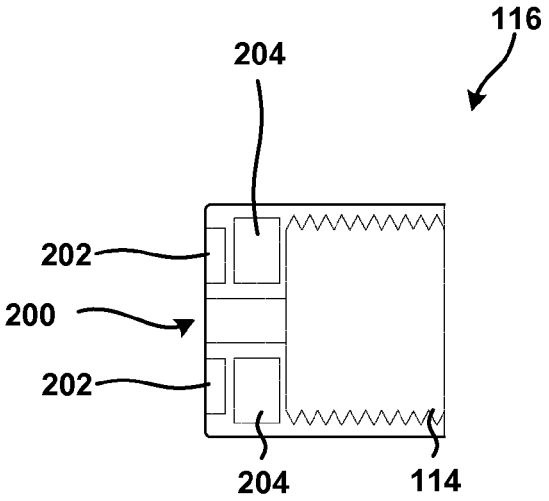
FIG. 2A is a line drawing illustrating a side view of a lighting attachment for a light-enhanced firearm suppressor, according to one illustrative embodiment of the concepts and technologies described herein.
Figure 2B:
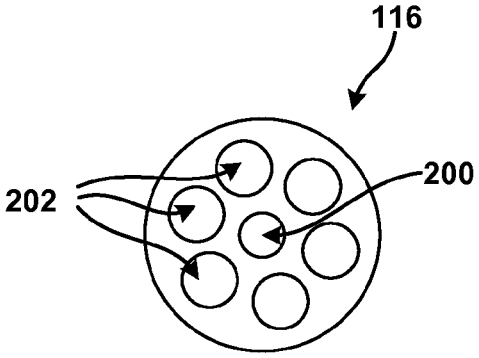
FIG. 2B is a line drawing illustrating a front view of the lighting attachment illustrated in FIG. 2A, according to one illustrative embodiment of the concepts and technologies described herein.

Turning now to FIGS. 2A-2B, additional aspects of the concepts and technologies described herein for light-enhanced firearm suppressors 100 will be described in detail. In particular, FIG. 2A illustrates a side view of a lighting attachment 116 for a light-enhanced firearm suppressor 100, according to one illustrative embodiment of the concepts and technologies described herein, and FIG. 2B illustrates a front view of the lighting attachment 116 illustrated in FIG. 2A, according to one illustrative embodiment of the concepts and technologies described herein. It should be understood that this example is illustrative and therefore should not be construed as being limiting in any way.

As can be seen in FIG. 2A, the lighting attachment 116 can include a bore or other bullet aperture ("aperture") 200. A bullet fired by a firearm can enter the housing 102, pass through baffles or other suppression elements or structures within the housing 102, enter the aperture 200, and pass through the aperture 200 and into the ambient environment such as the outside air or the like. As such, it can be appreciated that the aperture 200 can provide a path between the inner cavity 104 of the light-enhanced firearm suppress 100 and an outside environment, though this is not necessarily the case.

The lighting attachment 116 also can include lighting mechanisms 202. The functionality of the lighting mechanisms 202 can be provided by various light emission devices such as light bulbs, LEDs, laser devices, luminescent structures or panels, strobes, combinations thereof, or the like. The lighting mechanisms 202 can be sized and/or distributed within the lighting attachment 116 in any desired pattern and/or configuration. In the illustrated embodiment, the lighting attachment 116 includes six lighting mechanisms 202, which are radially distributed around an axis located at the center of the aperture 200. It should be understood that the illustrated embodiment of six lighting mechanisms 202 and/or that the lighting mechanisms are radially distributed about an axis are illustrative and should not be construed as being limiting in any way.

In particular, various embodiments of the lighting attachment 116 can include one, more than one, six, or more than six lighting mechanisms 202. Furthermore, various embodiments of the lighting attachment 116 can include lighting mechanisms 202 that are not radially distributed around a particular axis. Thus, the illustrated embodiment should be understood as being illustrative of only one contemplated embodiment and/or various principles associated with the embodiment, and should not be construed as being limiting in any way.

As can be seen in FIG. 2A, the lighting attachment 116 also can include one or more power sources 204. The functionality of the power sources 204 can be provided by one or more batteries, one or more power connections (e.g., to external or internal power sources), one or more solar panels, combinations thereof, or the like. In the illustrated embodiment, the functionality of the power sources 204 is provided by one or more batteries such as lithium ion batteries, or the like. It should be understood that the batteries can be configured with various shapes, depending upon power needs and/or design considerations. In one embodiment, for example, the power source 204 can be configured as a torus-shaped battery that can encircle the aperture 200. Thus, the volume of the power source 204 can be maximized based upon the need to leave the aperture 200 unobstructed. It should be understood that this example is illustrative and therefore should not be construed as being limiting in any way.

In some other embodiments, though not visible in FIGS. 2A-2B, a power source 204 such as a battery can be connected to one or more solar panels located on an outer surface 106 of the light-enhanced firearm suppressor 100, on the firearm to which the light-enhanced firearm suppressor 100 is attached, and/or elsewhere. The solar panel can be used to charge the power source 204, if desired. Because additional and/or alternative methods of charging and/or recharging the power source 204 are possible and are contemplated, it should be understood that this example is illustrative and therefore should not be construed as being limiting in any way.

Figure 3A:
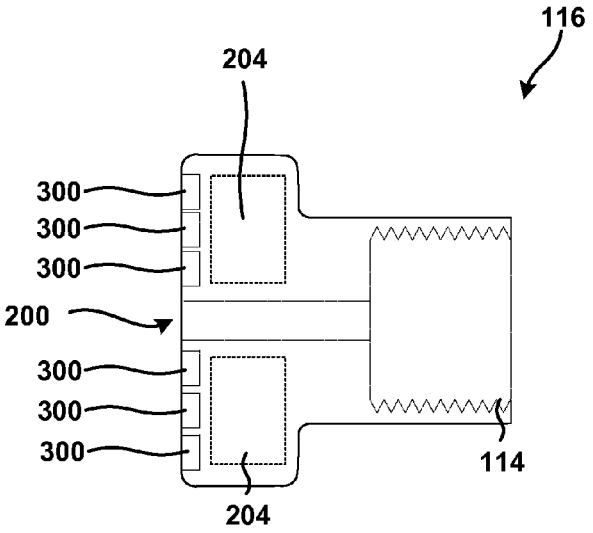
FIG. 3A is a line drawing illustrating a side view of a lighting attachment for a light-enhanced firearm suppressor, according to another illustrative embodiment of the concepts and technologies described herein.
Figure 3B:
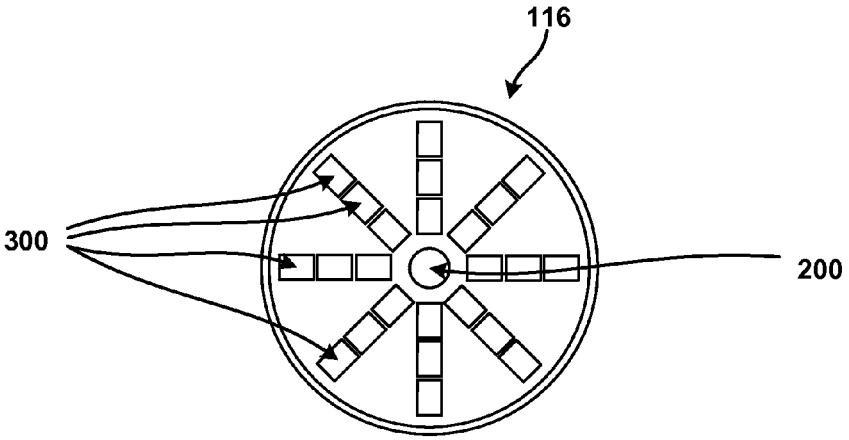
FIG. 3B is a line drawing illustrating a front view of the lighting attachment illustrated in FIG. 3A, according to one illustrative embodiment of the concepts and technologies described herein.

Turning now to FIGS. 3A-3B, additional aspects of the concepts and technologies described herein for light-enhanced firearm suppressors 100 will be described in detail. In particular, FIG. 3A is a line drawing illustrating a side view of a lighting attachment 116 for the light-enhanced firearm suppressor 100, and FIG. 3B is a line drawing illustrating a front view of the lighting attachment 116 illustrated in FIG. 3A. It should be understood that these examples are illustrative and therefore should not be construed as being limiting in any way.

With reference to FIG. 3A, it can be appreciated that the lighting mechanisms 202 discussed above with reference to FIGS. 2A-2B can be replaced with and/or supplemented by module lighting mechanisms 300 as shown in FIG. 3A. The modular lighting mechanisms 300 can be substantially similar to the lighting mechanisms 202, in some embodiments. In some other embodiments, the module lighting mechanisms 300 can be configured with comparatively lower power and/or output, relative to the lighting mechanisms 202, and as such, a larger number of the modular lighting mechanisms 300 may be included relative to the lighting mechanisms 202 discussed above. In some other embodiments, the modular mechanisms 300 can be substantially identical to the lighting mechanisms 202 discussed above. As such, the differences between the embodiments shown in FIGS. 2A-2B and FIGS. 3A-3B can be limited to the configuration and/or placement of the lighting mechanisms 202 and/or the modular lighting mechanisms 300, in some embodiments.

In the embodiment illustrated in FIGS. 3A-3B, the functionality of the modular lighting mechanisms 300 can be provided by LEDs arranged as shown in the illustrated embodiments. Additionally, it can be appreciated that the power sources 204 can be sized to support the modular lighting mechanisms 300, which can have a combined output and/or power consumption that is less than, equal to, and/or exceeds a power consumption and/or light output of the lighting attachment 116 illustrated in FIGS. 2A-2B. It should be understood that these examples are illustrative and therefore should not be construed as being limiting in any way.

Figure 4A:
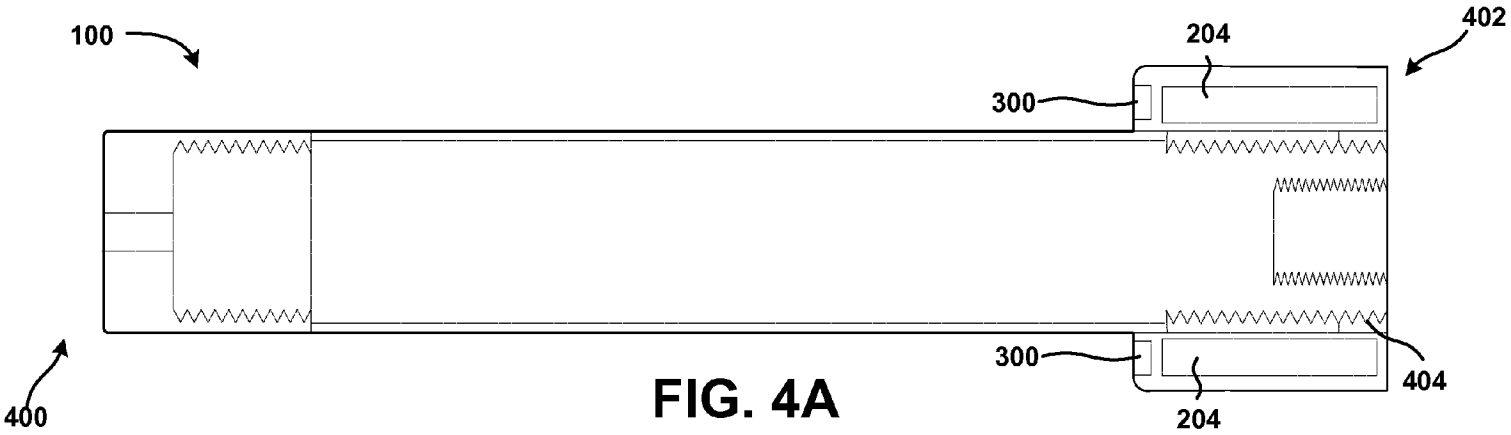
FIG. 4A is a line drawing illustrating a side view of a light-enhanced firearm suppressor, according to another illustrative embodiment of the concepts and technologies described herein.
Figure 4B:
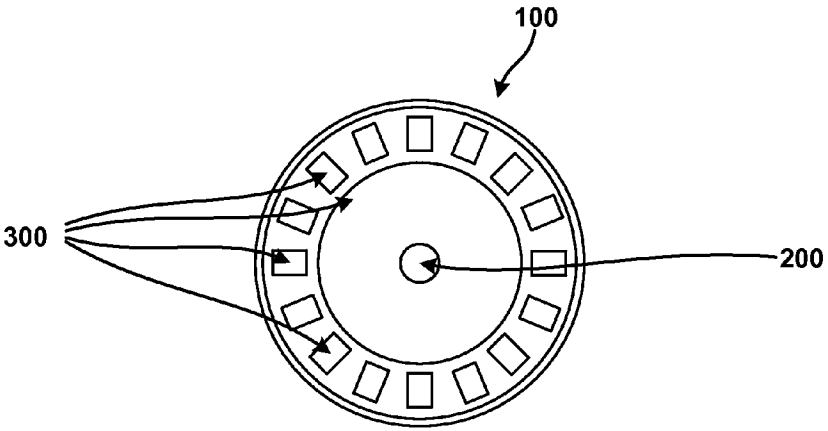
FIG. 4B is a line drawing illustrating a front view of the light-enhanced firearm suppressor illustrated in FIG. 4A, according to one illustrative embodiment of the concepts and technologies described herein.

Turning now to FIGS. 4A-4B, additional aspects of the concepts and technologies described herein for light-enhanced firearm suppressors 100 will be described in detail. In particular, FIG. 4A is a line drawing illustrating a side view of a light-enhanced firearm suppressor 100, according to another illustrative embodiment of the concepts and technologies described herein, and FIG. 4B is a line drawing illustrating a front view of the light-enhanced firearm suppressor 100 illustrated in FIG. 4A. It should be understood that these examples are illustrative and therefore should not be construed as being limiting in any way.

With reference to FIG. 4A, it can be appreciated that the lighting attachment 116 described herein can be located at an exit end 400 (also referred to herein as the "trailing edge") of the light-enhanced firearm suppressor 100 or at an entrance end 402 also referred to herein as the "leading edge") of the light-enhanced firearm suppressor 100. The lighting attachment 116 can be attached to the housing 102 via threads 404 located at the entrance end 402 of the light-enhanced firearm suppressor 100. In some other embodiments, the lighting attachment 116 may be formed as part of the housing 102 instead of, or in addition to, being formed as an attachment that is configured to engage the housing 102. Thus, the lighting attachment 116 can be formed as a lighting portion of the light-enhanced firearm suppressor 100, if desired. It should be understood that this example is illustrative and therefore should not be construed as being limiting in any way.

In some embodiments, locating the lighting attachment 116 and/or the components of the lighting attachment 116 such as the modular lighting mechanisms 300, lighting mechanisms 202 (not visible in FIGS. 4A-4B), and/or the one or more power sources 204 can locate weight associated with the lighting attachment 116 closer to the firearm relative to the design shown in FIGS. 3A-3B, though this is not necessarily the case. In some embodiments, locating the weight associated with the lighting attachment 116 closer to the firearm can result in improved balance, less strain for an operator, combinations thereof, or the like.

In some other embodiments, locating the weight closer to the exit end of the light-enhanced firearm suppressor 100 may be preferable in that this approach may reduce kickback associated with the firearm, may locate lighting mechanisms 202 and/or modular lighting mechanisms 202 closer to a target, combinations thereof, or the like. Because the lighting attachment 116 can be located at either end of the light-enhanced firearm suppressor 100 and/or elsewhere along the light-enhanced firearm suppressor 100, it should be understood that these examples are illustrative and therefore should not be construed as being limiting in any way.

It also should be understood, with reference to FIGS. 4A-4B, that the modular lighting mechanisms 300 shown in FIGS. 4A-4B and/or the arrangement thereof are merely illustrative. In particular, some embodiments of the light-enhanced firearm suppressor 100 can include zero, one, or more than one modular lighting mechanisms 300, additional and/or alternative lighting mechanisms such as the lighting mechanisms 202 illustrated and described herein, other light emitting devices such as lasers, luminescent panels, combinations thereof, or the like. As such, the radial arrangement of the modular lighting mechanisms 300 around the aperture 200 should be understood as being merely illustrative of one contemplated embodiment of the concepts and technologies described herein and should not be construed as being limiting in any way.

Figure 5A:
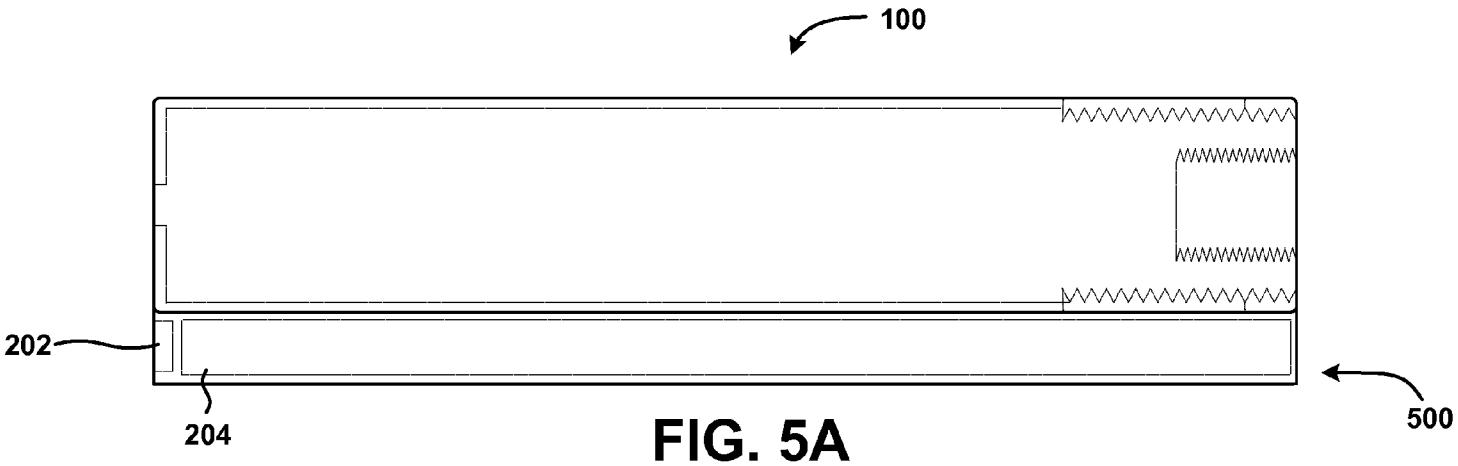
FIG. 5A is a line drawing illustrating a side view of a light-enhanced firearm suppressor, according to yet another illustrative embodiment of the concepts and technologies described herein.
Figure 5B:
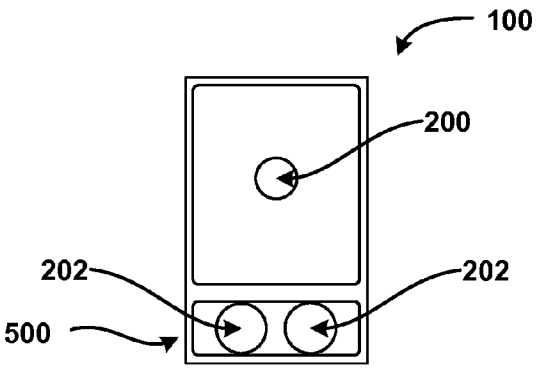
FIG. 5B is a line drawing illustrating a front view of the light-enhanced firearm suppressor illustrated in FIG. 5A, according to one illustrative embodiment of the concepts and technologies described herein.

Turning now to FIGS. 5A-5B, additional aspects of the concepts and technologies described herein for light-enhanced firearm suppressors 100 will be described in detail. In particular, FIG. 5A is a line drawing illustrating a side view of a light-enhanced firearm suppressor 100, according to yet another illustrative embodiment of the concepts and technologies described herein, and FIG. 5B is a line drawing illustrating a front view of the light-enhanced firearm suppressor 100 illustrated in FIG. 5A. It should be understood that these examples are illustrative and therefore should not be construed as being limiting in any way.

As shown with collective reference to FIGS. 5A-5B, the shape and/or configuration of the light-enhanced firearm suppressor 100 can be varied for various purposes. In particular, the shape and/or configuration of the light-enhanced firearm suppressor 100 can be varied for aesthetics, weight and/or balance of the light-enhanced firearm suppressor 100 and/or a firearm equipped with the light-enhanced firearm suppressor 100, to support varied lighting mechanisms 202 and/or power sources 204, combinations thereof, or the like. The embodiment shown in FIGS. 5A-5B are merely illustrative of some variations in the shape and/or configuration of the light-enhanced firearm suppressor 100 and should not be construed as being limiting in any way.

As can be appreciated with collective reference to the embodiment illustrated in FIGS. 5A-5B, the light-enhanced firearm suppressor 100 can have a rectangular, square, or other polygonal profile instead of the substantially cylindrical embodiments shown in FIGS. 2A-4B. Additionally, as can be seen in the embodiment shown in FIGS. 5A-5B, the light-enhanced firearm suppressor 100 can include an extended power source portion 500, which can accommodate multiple power sources 204 such as batteries, or the like. The extended power source portion 500 can extend along a length of the housing 102, as shown in FIGS. 5A-5B. In some embodiments, however, the extended power source portion 500 can extend along less than an entire length of the housing 102. The dimensions, configuration, and/or location of the power source portion 500 can be varied depending upon power needs, design needs, balance needs, and/or various aesthetic or design preferences or needs of the light-enhanced firearm suppressor 100.

As has been explained above, the number, placement, and/or configuration of the lighting mechanisms 202 can be varied for various aesthetic and/or functional considerations. As such, the illustrated embodiment of the light-enhanced firearm suppressor 100 shown in FIGS. 5A-5B is merely illustrative of one contemplated configuration of the various components of the light-enhanced firearm suppressor 100. As such, the illustrated embodiment should not be construed as being limiting in any way.

Figure 6A:
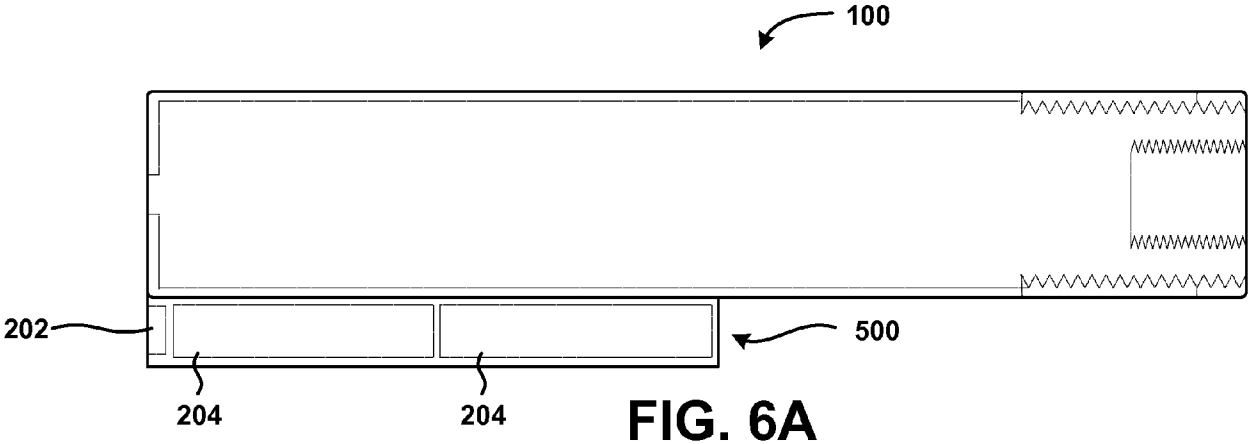
FIG. 6A is a line drawing illustrating a side view of a light-enhanced firearm suppressor, according to still another illustrative embodiment of the concepts and technologies described herein.
Figure 6B:
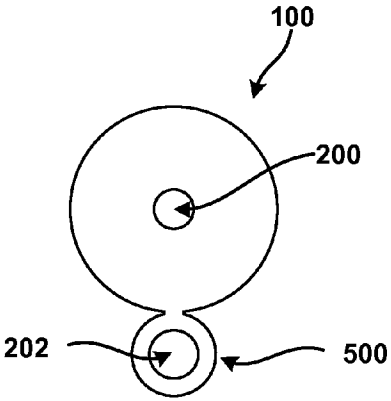
FIG. 6B is a line drawing illustrating a front view of the light-enhanced firearm suppressor illustrated in FIG. 6A, according to one illustrative embodiment of the concepts and technologies described herein.

Turning now to FIGS. 6A-6B, additional aspects of the concepts and technologies described herein for light-enhanced firearm suppressors 100 will be described in detail. In particular, FIG. 6A is a line drawing illustrating a side view of a light-enhanced firearm suppressor 100, according to still another illustrative embodiment of the concepts and technologies described herein, and FIG. 6B is a line drawing illustrating a front view of the light-enhanced firearm suppressor 100 illustrated in FIG. 6A. It should be understood that these examples are illustrative and therefore should not be construed as being limiting in any way.

As can be appreciated with reference to the embodiment of the light-enhanced firearm suppressor 100 shown in FIGS. 6A-6B, the extended power source portion 500 can extend along less than an entire length of the light-enhanced firearm suppressor 100, as explained above with reference to the embodiment of the light-enhanced firearm suppressor 100 shown in FIGS. 5A-5B. Similarly, as explained above, the extended power source portion 500 and/or a lighting mechanism 202 located within or at the extended power source portion 500 can be configured in any desired configuration such as the illustrated cylindrical embodiment. It should be understood that these examples are illustrative and therefore should not be construed as being limiting in any way.

Figure 7A:
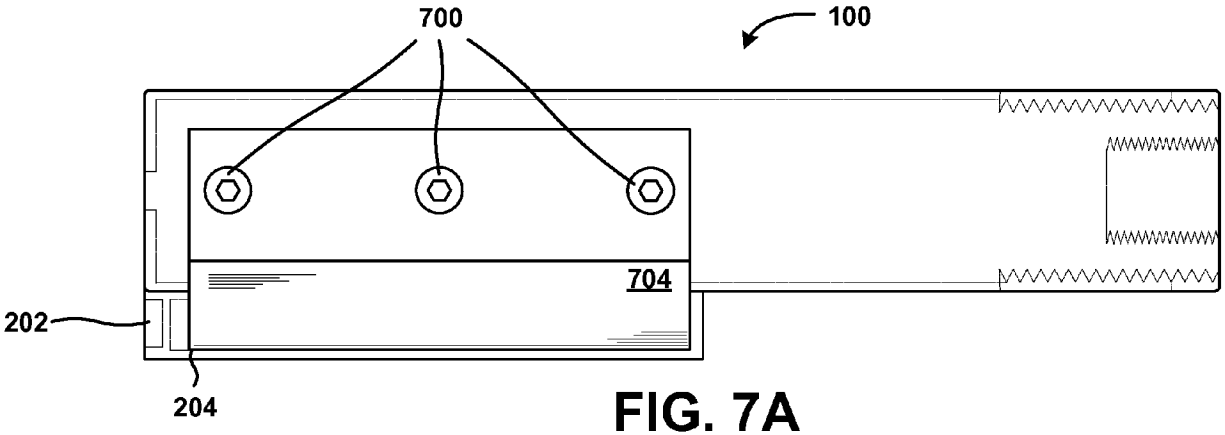
FIG. 7A is a line drawing illustrating a side view of a light-enhanced firearm suppressor, according to another illustrative embodiment of the concepts and technologies described herein.
Figure 7B:
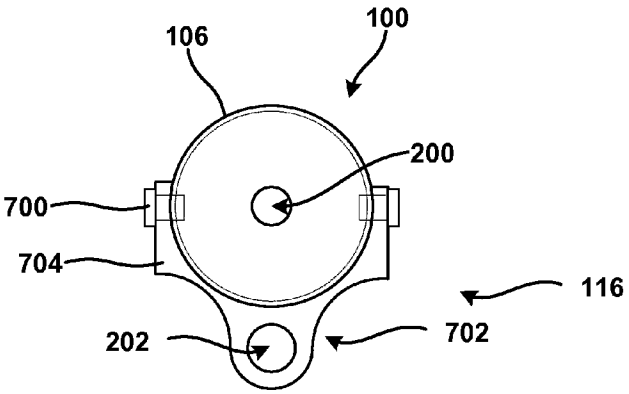
FIG. 7B is a line drawing illustrating a front view of the light-enhanced firearm suppressor illustrated in FIG. 7A, according to one illustrative embodiment of the concepts and technologies described herein.

Turning now to FIGS. 7A-7B, additional aspects of the concepts and technologies described herein for light-enhanced firearm suppressors 100 will be described in detail. In particular, FIG. 7A is a line drawing illustrating a side view of a light-enhanced firearm suppressor 100, according to another illustrative embodiment of the concepts and technologies described herein, and FIG. 7B is a line drawing illustrating a front view of the light-enhanced firearm suppressor 100 illustrated in FIG. 7A, according to one illustrative embodiment of the concepts and technologies described herein. It should be understood that these examples are illustrative and therefore should not be construed as being limiting in any way.

The embodiment of the light-enhanced firearm suppressor 100 shown in FIGS. 7A-7B illustrates alternative connection mechanisms for attaching the lighting attachment 116 to the housing 102. In the illustrated embodiment shown in FIGS. 7A-7B, the lighting attachment 116 is configured as a bolt-on lighting attachment that can be bolted to the housing 102 using bolts 700. It should be understood that the functionality of the bolts 700 can be provided by other connection mechanisms such as rivets, pins, screws, clips, clamps, combinations thereof, or the like. As such, the illustrated embodiment should be understood as being illustrative of one embodiment of the concepts and technologies described herein and should not be construed as being limiting in any way.

As can be appreciated with reference to the view shown in FIG. 7B, the lighting attachment 116 can include an integrated support bracket 702, which can include connection panels 704. The bolts 700 or other connection mechanisms can pass through the connection panels 704 and into the outer surface 106 of the housing 102. It should be understood that the bolts 700 or other connection mechanisms can be sized and/or configured to engage the outer surface 106 without passing through the outer surface 106. As such, it should be understood that the illustrated embodiment is merely illustrative and is shown to illustrate one possible configuration of the light-enhanced firearm suppressor 100. As such, the illustrated embodiment should not be construed as being limiting in any way.

Although not shown in the FIGURES, it should be understood that other attachments (in addition to or instead of the lighting attachment 116) can be attached to the light-enhanced firearm suppressor 100. For example, a grip can be located at a location that is similar or event identical to the various embodiments of the lighting attachment 116 shown in the FIGURES. Similarly, the light-enhanced firearm suppressor 100 can include picatinny rails and/or a picatinny rail attachment in addition to, or instead of, the illustrated embodiment. Thus, for example, an attachment similar to the attachment shown in FIGS. 7A-7B can be combined with the other embodiments of the lighting attachment 116 such as the embodiment shown in FIGS. 2A-2B to provide a light-enhanced firearm suppressor 100 that also can provide mounting surfaces for other firearm accessories such as grips, lights, sighting systems, combinations thereof, or the like.

Figure 8:
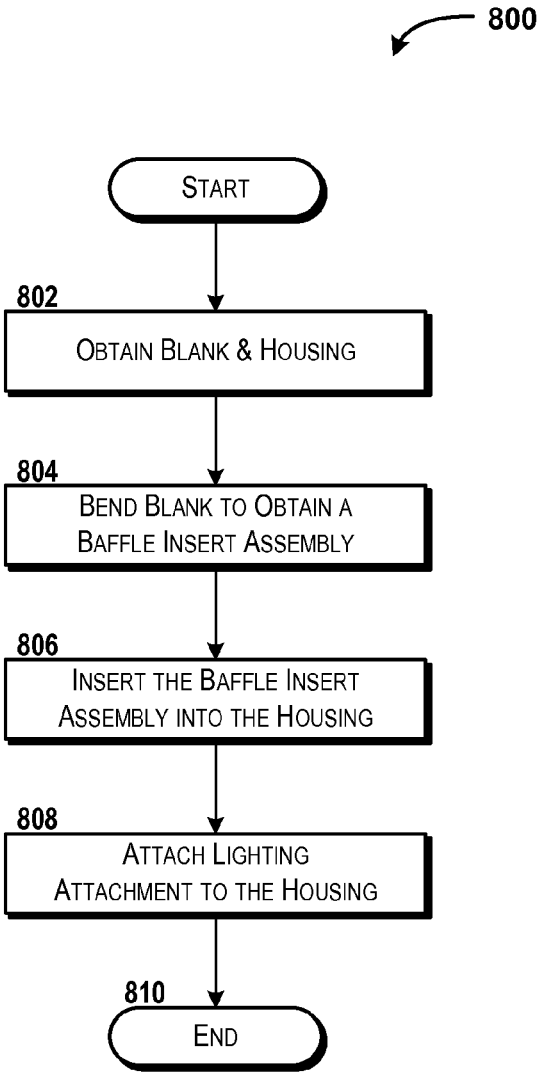
FIG. 8 is a flow diagram schematically illustrating a method for forming a light-enhanced firearm suppressor, according to one embodiment of the concepts and technologies described herein.

Turning now to FIG. 8, aspects of a method 800 for forming a light-enhanced firearm suppressor 100 will be described in detail, according to an illustrative embodiment. It should be understood that the operations of the method 800 disclosed herein are not necessarily presented in any particular order and that performance of some or all of the operations in an alternative order(s) is possible and is contemplated. The operations have been presented in the demonstrated order for ease of description and illustration. Operations may be added, omitted, and/or performed simultaneously, without departing from the scope of the appended claims. It also should be understood that the illustrated method 800 can be ended at any time and need not be performed in its entirety.

For purposes of illustrating and describing the concepts of the present disclosure, the method 800 is described as being performed by a forming device or series of forming devices (e.g., an assembly line) via execution of one or more software modules such as, for example, a suppressor forming application. It should be understood that additional and/or alternative devices can provide the functionality described herein via execution of one or more modules, applications, and/or other software including, but not limited to, the suppressor forming application. Thus, the illustrated embodiments are illustrative, and should not be viewed as being limiting in any way.

The method 800 begins at operation 802. In operation 802, the forming device obtains a baffle blank ("blank") and a housing such as the housing 102. The blank can include a piece of sheet metal that can be configured to form a baffle or other insert element that, when inserted into the housing 102, functions as a baffle or baffle set for a firearm suppressor. The housing can include the housing 102 described herein. It should be appreciated that the housing and the baffle can be obtained from more than one source, in some embodiments.

From operation 802, the method 800 proceeds to operation 804. In operation 804, the forming device can bend the blank to obtain a baffle insert assembly as described above. According to various embodiments, the blank can be bent multiple times by the forming device to provide a number of baffles or other surfaces that are arranged in a manner that is configured to provide silencing, muffling, or other suppression capabilities for a firearm suppressor. Details of one embodiment of the bending process illustrated in operation 804 are provided in co-pending U.S. patent application Ser. No. 14/134,023, filed on Dec. 19, 2013, which is incorporated herein by reference in its entirety. It should be understood that this example is illustrative and therefore should not be construed as being limiting in any way.

From operation 804, the method 800 proceeds to operation 806. In operation 806, the forming device can insert the baffle insert assembly into the housing obtained in operation 802. Thus, the baffle insert assembly can be inserted, for example, into the housing 102. It should be understood that this example is illustrative and therefore should not be construed as being limiting in any way.

From operation 806, the method 800 proceeds to operation 808. In operation 808, the forming device can attach a lighting attachment 116 to the housing 102 to form one embodiment of the light-enhanced firearm suppressor 100 described herein. Thus, it can be appreciated that the forming device can attach the lighting attachment 116 to the housing 102 in various ways including, but not limited to, bolts, screws, welds, adhesives, combinations thereof, or the like.

From operation 808, the method 800 proceeds to operation 810. The method 800 can end at operation 810.

Based on the foregoing, it should be appreciated that embodiments of a light-enhanced firearm suppressor have been disclosed herein. Although the subject matter presented herein has been described in conjunction with one or more particular embodiments and implementations, it is to be understood that the embodiments defined in the appended claims are not necessarily limited to the specific structure, configuration, or functionality described herein. Rather, the specific structure, configuration, and functionality are disclosed as example forms of implementing the claims.

The subject matter described above is provided by way of illustration only and should not be construed as limiting. Various modifications and changes may be made to the subject matter described herein without following the example embodiments and applications illustrated and described, and without departing from the true spirit and scope of the embodiments, which is set forth in the following claims.

I claim:

1. A light-enhanced firearm suppressor comprising:

a firearm suppressor housing;

an endcap located at a leading edge of the firearm suppressor housing;

a baffle; and a trailing edge cap comprising a lighting attachment, the trailing edge cap being located at a trailing edge of the firearm suppressor housing, wherein the firearm suppressor housing comprises an outer surface, an inner cavity that accommodates the baffle, a first attachment mechanism that attaches the leading edge of the firearm suppressor housing to a barrel of a firearm, and a second attachment mechanism that attaches, to the firearm suppressor housing, the trailing edge cap comprising the lighting attachment, wherein the baffle is secured in the firearm suppressor housing by the endcap and the trailing edge cap, and wherein the lighting attachment comprises a power source and a lighting mechanism.

2. The light-enhanced firearm suppressor of claim 1, wherein the firearm suppressor housing is formed from aluminum, wherein the first attachment mechanism comprises first female threads that engage first male threads on the barrel, and wherein the second attachment mechanism comprises second male threads that engage second female threads on the lighting attachment.

3. The light-enhanced firearm suppressor of claim 1, wherein a projectile fired from the firearm passes through the firearm suppressor housing from the leading edge to the trailing edge and through a bullet aperture formed in the lighting attachment.

4. The light-enhanced firearm suppressor of claim 1, wherein the lighting mechanism comprises a light bulb, and wherein the power source comprises a battery.

5. The light-enhanced firearm suppressor of claim 1, wherein the lighting mechanism comprises a light emitting diode, and wherein the power source comprises a battery.

6. The light-enhanced firearm suppressor of claim 1, wherein the lighting mechanism comprises a plurality of light emitting diodes, and wherein the plurality of light emitting diodes is radially arranged around a bullet aperture formed in the lighting attachment.

7. The light-enhanced firearm suppressor of claim 1, wherein the lighting mechanism comprises a light emitting diode and a laser emitting sighting system.

8. The light-enhanced firearm suppressor of claim 1, wherein the lighting attachment comprises a laser emitting sighting system.

9. A light-enhanced firearm suppressor comprising:

a firearm suppressor housing;

an endcap located at a leading edge of the firearm suppressor housing; and a trailing edge cap comprising a lighting attachment, the trailing edge cap being located at a trailing edge of the firearm suppressor housing, wherein the firearm suppressor housing comprises an outer surface, an inner cavity that is configured to contain a baffle, a first attachment mechanism that attaches the firearm suppressor housing to a barrel of a firearm, and a second attachment mechanism that attaches, to the firearm suppressor housing, the trailing edge cap comprising the lighting attachment, wherein the baffle is secured in the firearm suppressor housing by the endcap and the trailing edge cap, and wherein the lighting attachment comprises a power source and a lighting mechanism.

10. The light-enhanced firearm suppressor of claim 9, wherein the second attachment mechanism comprises threads formed on the firearm suppressor housing, and wherein the lighting attachment is connected to the firearm suppressor housing using the threads.

11. The light-enhanced firearm suppressor of claim 9, wherein the power source comprises at least one battery.

12. The light-enhanced firearm suppressor of claim 9, wherein the lighting mechanism comprises a light emitting diode.

13. The light-enhanced firearm suppressor of claim 9, wherein the lighting mechanism comprises a laser emitting sighting system.

14. The light-enhanced firearm suppressor of claim 9, wherein the firearm suppressor housing is formed from aluminum.

15. The light-enhanced firearm suppressor of claim 9, wherein the firearm suppressor housing is formed from titanium.

16. The light-enhanced firearm suppressor of claim 9, wherein the firearm suppressor housing is formed from steel.

17. A light-enhanced firearm suppressor comprising:

a housing;

a leading edge cap comprising a lighting attachment, the leading edge cap being located at a leading edge of the housing;

a baffle; and a trailing edge cap located at a trailing edge of the housing, wherein the housing comprises an outer surface, an inner cavity, a first attachment mechanism that attaches the leading edge of the housing to a barrel of a firearm, and a second attachment mechanism that attaches the trailing edge cap to the housing, and wherein the lighting attachment comprises a lighting mechanism and a power source and is located at the leading edge of the housing.

18. The light-enhanced firearm suppressor of claim 17, wherein the lighting mechanism emits light in a visible wavelength.

19. The light-enhanced firearm suppressor of claim 17, wherein the lighting mechanism emits light in an invisible wavelength.

20. The light-enhanced firearm suppressor of claim 17, wherein the lighting mechanism comprises a plurality of light emitting diodes radially arranged around a bullet aperture formed in the lighting attachment, and wherein the power source comprises a battery.

* * * * *